United States Patent [19]

Gale et al.

[11] 4,111,617

[45] Sep. 5, 1978

[54] ROTARY PISTON MECHANISM

[76] Inventors: Richard A. Gale, Main St., Vineyard Haven, Mass. 02568; Donald L. Kahl, 62 Pleasant Hill Dr., Scituate, Mass. 02066

[21] Appl. No.: 616,672

[22] Filed: Sep. 25, 1975

[51] Int. Cl.[2] ..... F02B 53/00

[52] U.S. Cl. ..... 418/61 B

[58] Field of Search ..... 123/8.45; 418/54, 61 R, 418/61 B, 260

[56] References Cited

U.S. PATENT DOCUMENTS

| | | | |
|---|---|---|---|
| 2,871,831 | 2/1959 | Patin | 418/61 B |
| 3,199,496 | 8/1965 | Kell | 418/61 B X |
| 3,285,189 | 11/1966 | Doyer | 418/54 |
| 3,301,228 | 1/1967 | Winans | 418/61 B X |
| 3,314,401 | 4/1967 | Kell | 123/8.45 |
| 3,364,907 | 1/1968 | Jeanson | 418/61 B |
| 3,441,007 | 4/1969 | Kwaak | 418/61 B X |
| 3,771,501 | 11/1973 | DeDobo | 418/61 B X |
| 3,800,760 | 4/1974 | Knee | 418/54 X |
| 3,913,408 | 10/1975 | Moore | 418/54 X |

FOREIGN PATENT DOCUMENTS

| | | | |
|---|---|---|---|
| 890,084 | 10/1943 | France | 418/54 |

*Primary Examiner*—Carlton R. Croyle
*Assistant Examiner*—Michael Koczo, Jr.
*Attorney, Agent, or Firm*—Robert T. Dunn

[57] ABSTRACT

A rotary piston mechanism for internal combustion engines, fluid motors, pumps and the like has an outer body enclosing a chamber that is defined by curvilinear walls that circumscribe the chamber axis, and a generally elongated rotor is confined in the chamber and rotatably supported by a rotor carrier that closes one end of the chamber and is rotatably supported on the chamber axis by the outer body so that the rotor rotates on the rotor axis which is parallel to the chamber axis and around the chamber axis over a closed path, the sense of rotation of the rotor on the rotor axis being opposite to the sense of rotation of the rotor axis around the chamber axis, and the rotor is oriented on the rotor axis by a gear train between the rotor and the rotor carrier.

30 Claims, 30 Drawing Figures

POWER EXHAUST & INTAKE

EXPANSION & COMPRESSION

POWER EXHAUST & INTAKE

EXPANSION & COMPRESSION

POWER EXHAUST & INTAKE

EXPANSION & COMPRESSION

POWER EXHAUST & INTAKE

1-POWER 2-COMP

2-POWER 3-EXH

3-INT 1-EXH

1-INT 2-COMP

2-POWER 3-COMP

3-POWER 1-EXH

1-INT 2-EXH

2-INT 3-COMP

3-POWER 1-COMP

1-POWER 2-EXH

2-INT 3-EXH

3-INT 1-COMP

ROTARY PISTON MECHANISM

BACKGROUND OF THE INVENTION

This invention relates to rotary piston mechanisms and more particularly, to such a mechanism for internal combustion engines, fluid motors, pumps and the like, wherein a rotating piston or rotor captured in a chamber moves eccentrically with respect to an output or an input drive shaft emanating therefrom.

Rotary piston internal combustion engines exemplified by the Wankel type engine have a generally triangular shaped rotor in an epitrochoidal chamber. The rotor is eccentrically driven in the chamber as it rides eccentrically about a fixed centrally located gear. Thus, the output drive shaft connected to the rotor is driven at the same rotation rate as the rotor. The three points of the rotor are equipped with sliding seals that engage the inner walls of the chamber and divide the chamber into three spaces, each bounded by one of the faces of the rotor. During a complete revolution of the rotor, each of these spaces moves around the chamber increasing the decreasing in size to perform the four functions of intake, compression, power and exhaust as a gasoline, air mixture is drawn into the space, compressed, combusted to deliver power as it expands, and then finally, exhausted. These functions are performed in all the moving spaces during each rotation of the rotor in the chamber and the power function is performed consecutively in the spaces, always along the same portion of the walls of the chamber. The other functions are also performed consecutively in each of the spaces and each of them is also performed along a given portion of the walls of the chamber. Thus, the combustion and exhaust functions which inflict the greatest wear on the walls of the chamber, occur repeatedly along the same portions of the chamber walls and so, the effectiveness of the seals carried at each of the points of the rotor are inclined to degrade along these portions of the chamber walls.

It is intrinsic to the Wankel type engine and to any type rotary piston mechanism that uses a triangular shaped rotor which seals against the chamber walls at the points of the triangle, that the chamber be epitrochoidal with two symmetrical cusps. Hence, with respect to the axis of the chamber, the walls of the chamber are curvilinear and concave at all points except at the two cusps. At that point, the walls are generally convex with respect to the chamber axis. Hence, the seals must follow a concave wall which changes abruptly to convex at two points along a complete cycle of travel of the seal against the wall and so the angle the seal subtends with the wall is not constant during the entire travel of the seal along the wall. In fact, that angle becomes exceedingly acute as it moves along the wall from a convex portion of the wall to a concave portion. The effectiveness of the seal where the angle is exceedingly acute, is diminished and the seals have a tendency to leak at such points.

Another rotary piston mechanism in which some of the disadvantages of the Wankel type mechanism are avoided is disclosed in our copending U.S. patent application Ser. No. 445,930, entitled Rotary Piston Mechanism, filed Feb. 26, 1974, and now U.S. Pat. No. 3,996,901. A similar mechanism is also described in U.S. Pat. No. 3,285,189 which issued Nov. 15, 1966 to C. Doyer and is entitled Motor, Pump or Compressor with a Piston Rotatable Within the Housing. Both our copending application and the Doyer patent describes an oblong rotary piston or rotor in a generally triangular shaped chamber defined by three equal curved walls that are convex with respect to the chamber axis. Each side of the rotor conforms generally to the chamber wall and the rotor is rotatably mounted so that it rotates about its geometric center and the geometric center moves around the chamber axis over a three cusp epicycloidal path. For each cycle of rotation of the geometric center of the rotor around the chamber axis along the epicycloidal path, the rotor rotates one-half cycle on its geometric center and so the rotor closes successively with the three walls of the chamber six times for each full revolution of the rotor. Furthermore, seals at the ends of the rotor which slide along the walls of the chamber can at all times contact the walls perpendicular thereto.

In Doyer, the chamber is closed at the ends by fixed plates. The plates are fixedly attached to an annular part that defines the chamber and relatively large central openings are provided in the plates to which shafts and axles extend for carrying the rotor and for delivering a shaft output from the rotor. With this construction, it is required that the width of the rotor be relatively large because it must cover these large central openings in the plates even when the rotor is in an extreme position against one of the chamber walls. In other words, the width of the rotor must be substantially greater than the shortest distance from the chamber axis to one of the chamber walls. Thus, it is intrinsic in Doyer that the area of the rotor must be more than half the area of the chamber. This, of course, limits the intake volume for a fixed chamber size.

In our U.S. Pat. No. 3,996,901, the above described limitation of Doyer is avoided by providing rotating end plates that connect directly to the output shaft and which carry the rotor on an axle which is eccentric with respect to the output shaft. Hence, there are no central openings through the ends of the chamber which must be covered by the rotor. Furthermore, the rotating end plates contain intake and exhaust holes which come into registration with fixed intake and exhaust holes in the mechanism housing. This enables a two cycle type of operation with six power strokes for each revolution of the rotor about its geometric center. Such operation is not possible in Doyer which provides only two power strokes for each revolution of the rotor about its geometric center.

The present invention discloses an improvement in the rotary piston mechanism described in our U.S. Pat. No. 3,996,901. More particularly, the present invention provides a gear train carried by at least one of the rotating chamber end plates that carries the rotor for rotating the rotor on the rotor axis (geometric center). Thus, the rotor position and attitude is totally controlled by connections to and through the rotating end plate, and, therefore, independent of contact with the chamber side walls.

SUMMARY OF THE INVENTION

In all embodiments of the present invention, the rotary piston mechanism for internal combustion engines, fluid motors, pumps and the like has an outer body enclosing the chamber that is defined by convex curved side walls that circumscribe the chamber axis. At least one end of the chamber is closed by a rotating end plate attached to a shaft journalled to the mechanism housing and that plate carries the rotor in the chamber on a double eccentric axle consisting of a second axle eccentrically connected to a first axle that is eccentrically carried by the plate. A gear train between the first axle and the housing causes the double axle to rotate at a rate relative to the rotation rate of the plate, moving the geometric center of the rotor along a closed hypocycloidal path around the chamber axis. Another gear train between the first axle and the rotor controls the attitude of the rotor on its geometric axis. Thus, both the position and the attitude of the rotor in the chamber are positively controlled by gears and are independent of forces between the rotor and the side walls of the chamber.

In one embodiment of the present invention, similar rotating end plates are employed, one at each end of the chamber, connected by the first axle so that the first axle is supported at one end by one end plate and at the other end by the other end plate and the rotor is carried between the plates on the second axle which eccentrically attaches to the first axle. In this embodiment, the end plates may be equipped with intake and exhaust holes located to register with fixed intake and exhaust ports in the housing to accomodate fluid flow into and out of the chamber in synchronism with rotation of the rotor.

In another embodiment of the present invention, only one rotating end plate is used, the other end of the chamber is closed by a fixed plate. The single rotating end plate carries both axles, the rotor and the gear train that control the attitude of the rotor and so rotor position and attitude are independent of forces between the rotor and the side walls of the chamber.

Both embodiments of the present invention can be employed in a rotary piston mechanism wherein the rotor is of fixed dimension from end to end. In other words, the dimension of the rotor from vane tip to vane tip is fixed. In that case, there are three equal convex chamber side walls that define an equilateral triangle and the span of the chamber along a bisector of any of the angles of the equilateral triangle must be precisely equal to the length of the rotor from vane tip to vane tip. Both embodiments described herein can also be used in a rotary piston mechanism in which the length of the rotor from vane tip to vane tip changes during a cycle of rotation and so the chamber shape need not define an equilateral triangle as described. For example, the chamber can be circular and sealing vanes carried by the rotor are driven in and out of the rotor changing the length of the rotor from vane tip to vane tip as necessary to divide the chamber at all times into two sections each sealed from the other. Such a mechanism is described by another embodiment of the present invention.

The action or motion of the rotor with respect to the chamber driven and controlled by gear trains in accordance with the present invention, can be applied to an internal combustion engine, a fluid motor or a fluid pump and specific embodiments of the present invention are described herein for all of these applications. More particularly, operation of this rotary piston mechanism to perform as a two cycle internal combustion engine, a four cycle internal combustion engine, a fluid motor and a fluid pump are all described herein or they are apparent in view of the embodiments described.

Accordingly, it is an object of the present invention to provide a rotary piston mechanism for internal combustion engines, fluid motors, pumps and the like, having a chamber containing a single generally oval shaped rotor, carried by a rotating end plate that closes one end of the chamber, the rotor successively closing with different portions of the walls of the chamber three times for each half revolution of the rotor and wherein the position and attitude of the rotor in the chamber is independent of forces on the rotor at points where the rotor contacts the chamber walls.

It is a further object to provide such a rotary piston mechanism wherein the rotor position and attitude are precisely controlled by gears.

It is a further object to provide such a mechanism capable of performing as a two cycle internal combustion engine with six power strokes for each revolution of the rotor in the chamber.

It is a further object to provide such a mechanism operating as a four cycle internal combustion engine with three power strokes for each revolution of the rotor.

It is a further object to provide such a four cycle internal combustion engine including two or more chambers and a rotor in each in cascade driving a single output shaft.

It is another object to provide a rotary piston fluid motor wherein driving fluid enters a chamber and is exhausted from the chamber as many as six times for each revolution of the rotor.

It is a further object to provide a rotary piston pump wherein fluid enters and leaves the chamber under pump pressure as many as six times for each revolution of the rotor.

Other objects, features and advantages of the present invention and various embodiments thereof will be apparent from the following description of these features and embodiments taken in conjunction with the drawings.

DESCRIPTION OF THE EMBODIMENTS OF THE INVENTION

BASIC ROTOR ACTION

Figure 1:
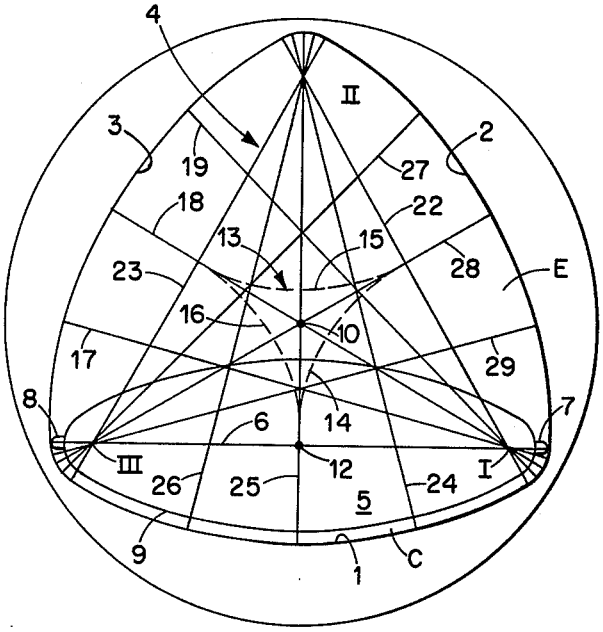
FIG. 1 is a diagram showing the generic chamber geometry, the rotor, successive positions of the rotor and the locus of the center of the rotor over one complete cycle of rotation of the rotor.

The configuration of the chamber and the rotor and the required positioning of the rotor in the chamber in accordance with generic features of the present invention is shown in FIG. 1. The shape of the chamber in a plane transverse to the axis of the chamber is defined by the three sides or walls 1, 2 and 3. The sides are curvilinear and are equal and at every point along all three sides they are convex with respect to the chamber axis 10 represented by the dot at the geometric center of the chamber. The chamber configuration shown in this figure defines an equilateral triangle 4 whose geometric center is at 10.

The elongated rotor 5 or rotary piston as it is sometimes called, is contained within the chamber. The longitudinal axis 6 of the rotor may coincide with one of the legs of the equilateral triangle at a position of the rotor chamber shown in FIG. 1. Sealing vanes 7 and 8 extend from opposite ends of the rotor along the rotor longitude 6 and contact two of the curvilinear walls such as walls 2 and 3 as in FIG. 1. Thus, in this position, the rotor divides the total chamber into two portions, a small portion C and a large portion E sometimes called the compressed and expanded portions of the chamber. The compressed portion C is the space defined by wall 1 and side 9 of the rotor and the expanded portion E is defined by side 11 of the rotor and walls 2 and 3 at the rotor position in this figure.

The basic operation of the rotor in the chamber is shown in FIG. 1. The chamber is provided inside a body which is mechanically grounded and means are provided from the same mechanical ground for carrying the rotor within the chamber so that the axis of the rotor at point 12 at the geometric center of the rotor and parallel to the chamber axis 10, moves repeatedly around the chamber axis along a three cusp hypocycloidal path 13, represented by broken lines 14, 15 and 16. In other words, the locus of positions of the rotor axis 12, as the rotor rotates within the chamber, defines a three cusp hypocycloid centered on the chamber axis.

At each position of the axis 12 of the rotor, the longitudinal axis 6 of the rotor is substantially perpendicular to a side of the three cusp hypocycloid 13 that is defined by the locus of the rotor axis 12. Thus, the lines 17, 18 and 19 span the chamber and all go through one point of the equilateral triangle 4 denoted I. Hence, the rotor rotates about an axis at I which is stationary with respect to the chamber over a portion of the rotor's rotating cycle during which the rotor axis 12 that moves with the rotor and is geometrically centrally located therein moves over one leg of the three cusp hypocycloid 13.

Upon completing rotation of the rotor about the axis I, the rotor arrives at a position where the longitudinal axis 6 coincides with side 22 of the equilateral triangle 4. Next, the rotor rotates about axis II which is fixed relative to the chamber to the next position of the rotor alongside wall 3 where the longitudinal axis 6 of the rotor coincides with leg 22 of equilateral triangle 4. Next, the rotor rotates about point III of the equilateral triangle until the longitudinal axis 6 arrives again in coincidence with leg 21 of the triangle at which point the rotor has completed one-half of a cycle of rotation about its own axis 12. Furthermore, it should be noted that when the rotor rotates from the position shown in FIG. 1, first about axis I then about axis II, then about axis III, as already described, the rotor will have completed only one-half cycle of rotation about its own axis 12 and at the end of this sequence the rotor will be upside down and backwards compared to the position shown in FIG. 1. From this position, the rotor must rotate again about axis I, then about axis II, then axis III to again be in the same position as shown in FIG. 1.

The successive positions of the longitudinal axis 6 of the rotor as the rotor rotates about axis II, represented by lines 24, 25 and 26 which span the chamber and these successive positions of the rotor axis 6 as the rotor rotates about axis III are represented by lines 27, 28 and 29.

Where the dimensions of the rotor from the tip of vane 7 to the tip of vane 8 are fixed, then the greater arcs of each of the three walls 1, 2 and 3 (each defined by extensions of sides of the equilateral triangle 4 from the opposing points of the triangle), are equal arcs of constant radius, the centers of these arcs being at the axes I, II and III. Furthermore, the short arcs joining these major arcs to complete the walls are centered at the same axes I, II and III and are of equal radius. These short arcs are asymptotic to the long arcs. By this construction, all of the positions of the rotor in the chamber shown in FIG. 1 and represented by lines which span the chamber are spans of equal length and so, a rotor of fixed longitudinal dimension fits exactly between two walls of the chamber touching both walls at all times. Furthermore, the seals 7 and 8, the ends of which slide along and seal against the walls at all times, divide the total chamber in two portions, C and E which at all times are sealed from each other. These portions are generally referred to herein at the compression and expansion portions depending upon which way the rotor is moving at the time. It is the intended scope of the present invention to apply the action described hereinabove with respect to FIG. I in a two cycle combustion engine, a four cycle combustion engine, a fluid motor and a fluid pump.

Rotor Position and Attitude Control Mechanisms

Figure 2:
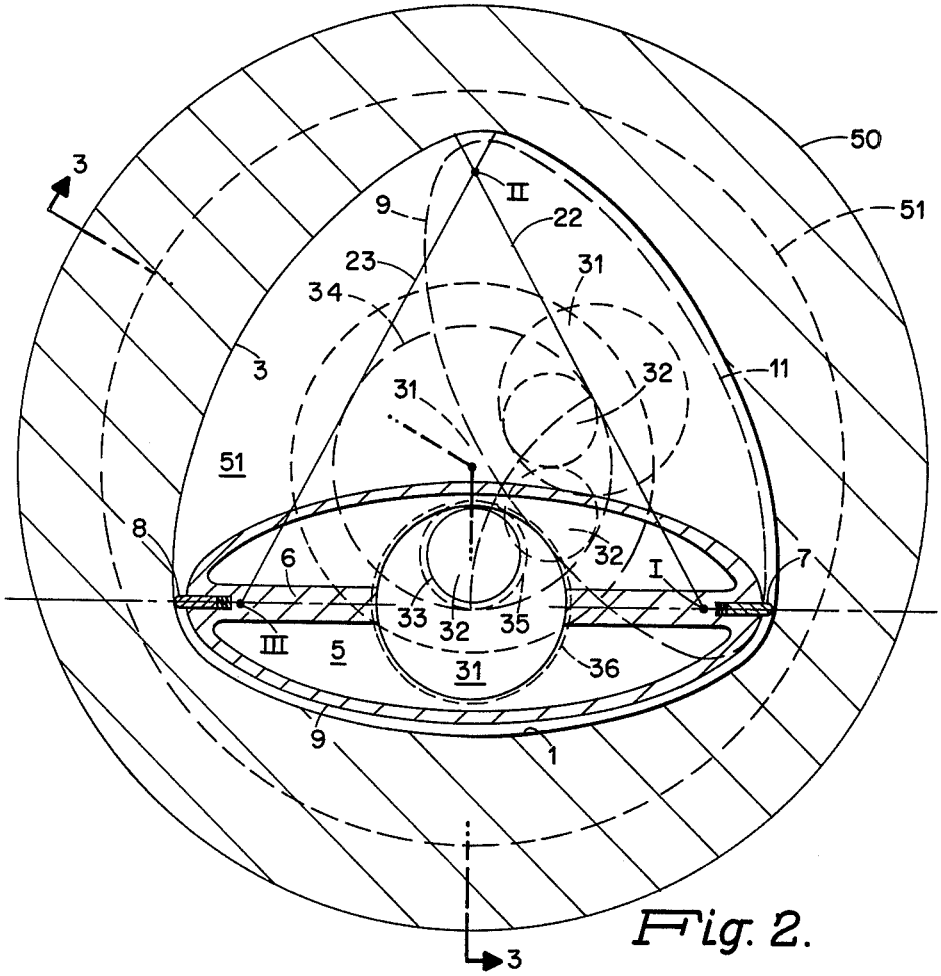
FIG. 2 is a cross section view of the basic embodiment shown in FIG. 3 taken at 2—2 showing the chamber configuration and rotor wherein the generic cycle shown in FIG. 1 is accomplished using a rotating end plate carrying a double eccentric axle journalled to the center of the rotor and with two separate gear trains, one acting between the double eccentric axle and the chamber housing, and the other acting between the rotor and the rotating plate, for controlling the position and attitude of the rotor in the chamber independent of contact of the rotor with the chamber walls.
Figure 3:
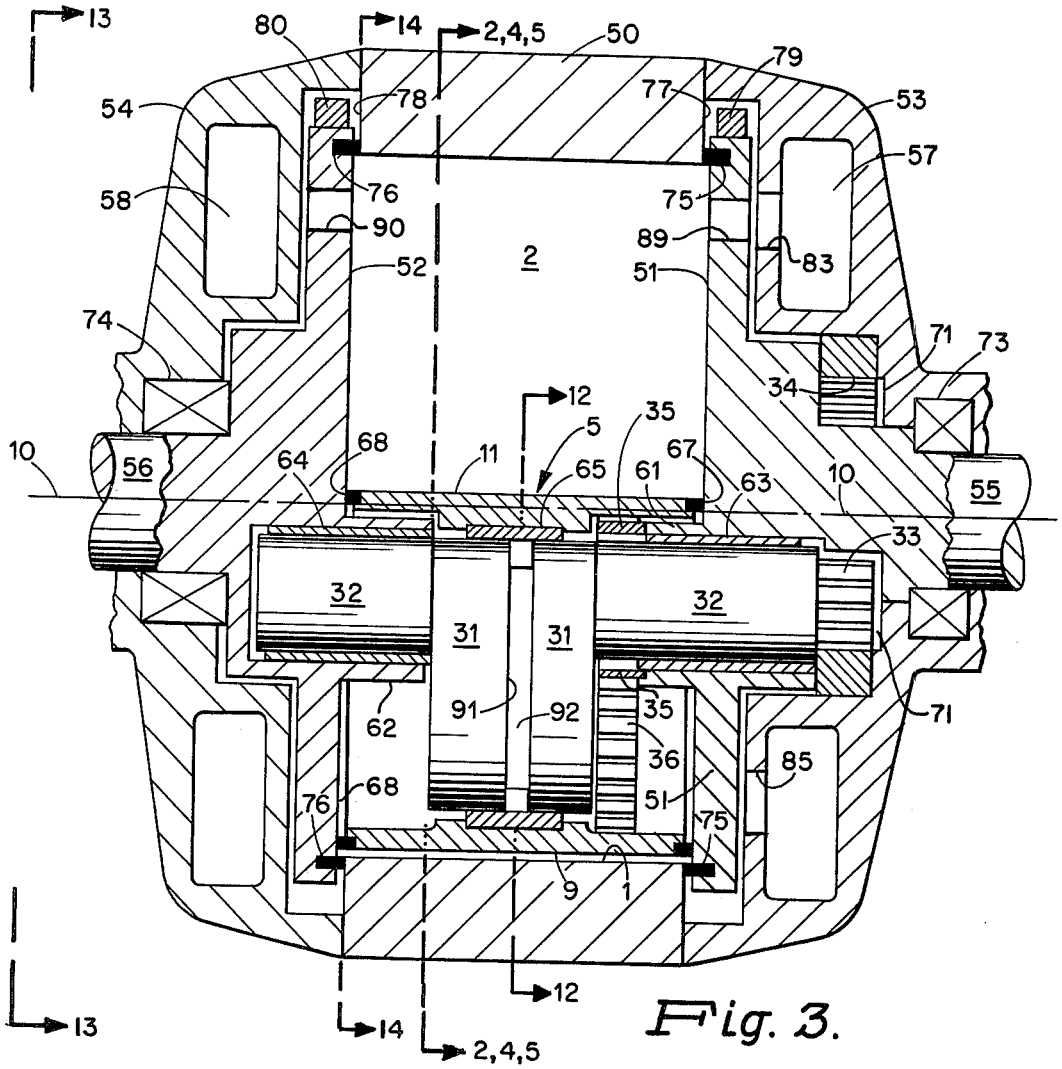
FIG. 3 illustrates a basic embodiment of the present invention that can be used as an internal combustion engine, fluid motor or fluid compressor, including two end plates carrying a double eccentric axle at opposite ends thereof, showing a cross section view taken at 3—3 in FIG. 2 through the chamber axis parallel thereto.

FIGS. 2 and 3 illustrate the mechanical action of a basic embodiment of the present invention for carrying the rotor in the chamber and controlling the position and attitude of the rotor over its cycle of rotation in the chamber to perform the action described above with respect to FIG. 1. As shown in FIG. 2, the rotor 5 is journalled centrally to the eccentric axle 31 so that the axis of axle 31 and the central axis 12 of the rotor (at the geometric center of the rotor) coincide. Axle 31 is fixed to axle 32 that is carried by the rotating end plate 51 which is journalled to the mechanism housing that attaches to the chamber body 50 so that the end plate 51 rotates on the chamber axis 10. Thus, the end plate 51 delivers a shaft output when the mechanism is used as an internal combustion engine or a fluid motor and a shaft input is applied to the end plate when the mechanism is used as a fluid pump.

The two axles 31 and 32 are fixedly attached and are referred to herein as the double eccentric axle because the axle 32 is mounted to the plate 51 eccentrically with respect to the axis of rotation (10) of the plate 51 and the axle 31 is eccentric with respect to axle 32. Thus, as the plate rotates about axis 10, both axles 31 and 32 orbit around axis 10. In other words, the double eccentric axle 31/32 is carried by plate 51 in orbit around the chamber axis 10.

As already mentioned, axle 32 is journalled to the plate 51. It extends through the plate and carries at the end thereof which extends through the plate a pinion gear 33. The pinion gear meshes with an internal gear 34 concentric with the axis 10 and fixed to the housing and the ratio of internal gear 34 to pinion gear 33 is 3:1. Thus, from the initial position of the double eccentric axle 31/32 and rotor 5 represented by the cross hatched rotor and defined by the solid lines in FIG. 2, the end plate 51 rotates counterclockwise (ccw) causing the pinion gear 33 to rotate to the successive positions shown in FIG. 2, which, in turn, positions the rotor axle 31 at the corresponding successive position shown in the figure. Since the center of axle 31 at all times coincides with the axis 12 of the rotor, it is quite clear that the axis 12 moves along one leg 14 of the hypocycloidal path when the end plate 51 rotates ccw 120°. While this action moves the center of the rotor as described and shown in FIG. 1 over the hypocycloidal path, it does not control the attitude of the rotor; more particularly, it does not cause the rotor to rotate precisely first about axis I then about axis II and then about axis III and so forth to accomplish the action described above with respect to FIG. 1. With no more control than this, the proper rotor attitude would be maintained only by the force of the chamber walls on the rotor at the vane tips and this would restrict use of the mechanism to the triangular shaped chamber.

In accordance with the present invention, a second gear train is provided for rotating the rotor ccw relative to the rotor axle 31 so that the rotor will, in effect, rotate successively about the axes I, II, and III to complete one-half cycle of the rotor about its axis 12. The second gear train referred to herein as the rotor attitude gears includes an external gear 35, concentric with axle 32 and fixedly attached to the plate 51 meshing with an internal gear 36 concentric with axle 31 and fixedly attached to the rotor. The ratio of gears 36 to 35 is 2:1. Clearly, as the plate 51 rotates ccw, gear 35 moves to the successive position shown in FIG. 2 and since it is fixed to plate 51, it orbits around chamber axis 10 and rotates ccw about the axis of axle 32. Meanwhile, the rotor axle 31 moves along leg 14 of the hypocycloidal path and rotates cw 240° on axis 12.

Figure 12:
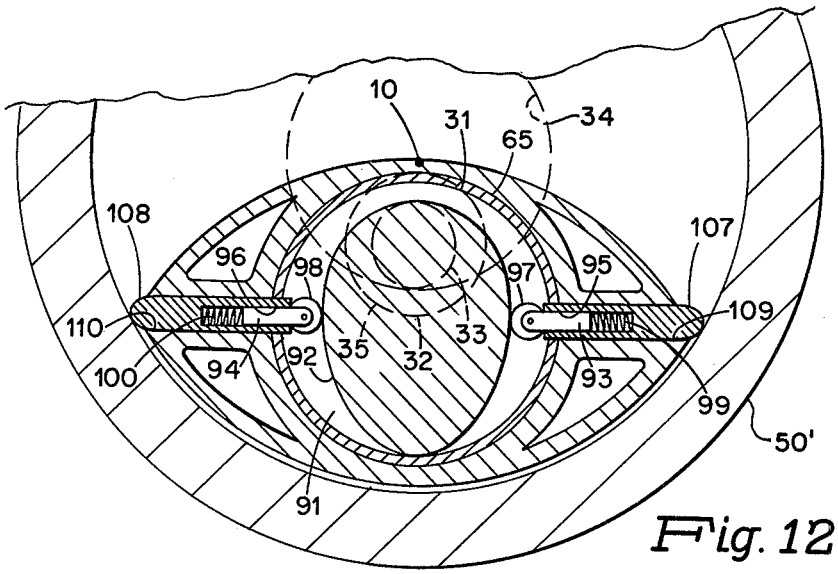
FIG. 12 illustrates a mechanism for use with any of the embodiments described herein for controlling the position and attitude of the rotor and in addition, including sealing vanes at the ends of the rotor which are cam driven so that the overall length of the rotor from vane tip to vane tip varies as the rotor rotates, allowing use of, for example, a circular chamber.

The attitude gear train, as stated above, controls rotor attitude and includes gears 35 and 36 that drive the rotor ccw so that it only rotates cw 60° about its axis 12 over the path 14 even while axle 31 rotates 240°. Thus, the rotor position is precisely determined by the first gear train including gears 33 and 34 and the rotor attitude is precisely determined by the second gear train including gears 35 and 36 and both rotor position and attitude are independent of any forces exerted at the rotor vane tips 7 and 8 where they contact the chamber side walls. Clearly, these vanes may be fixed at the ends of the rotor where the chamber configuration is as described in FIGS. 1 and 2 and the vanes will at all times seal against the side walls of the chamber dividing the chamber into the two parts C and E. On the other hand, where means are provided for varying the length of the rotor from vane tip to vane tip as the rotor rotates, chambers of other configurations can be used. For example, with variable vanes properly driven in and out of the rotor body in synchronism with rotor rotation, even a circular chamber such as shown by FIG. 12, can be used with the mechanism shown in FIG. 2 for carrying the rotor and controlling the rotor position and attitude.

First Embodiment — Both Chamber End Plates Rotating

The mechanism and action described above and represented by FIG. 2 is incorporated in the first basic embodiment of the invention which includes two rotating end plates that close the ends of the chamber and are carried on shafts journalled to the mechanism housing concentric with the chamber axis 10. This embodiment is shown by cross section view taken through the axis 10 parallel thereto as shown in FIG. 3 and by FIG. 2 which is also a cross section view. This mechanism is close to being symmetrical with respect to a central plane perpendicular to the axis 10 and could be symmetrical except for the two gear trains and the accomodations for the gear train. The one rotating end plate 51 is referred to as the intake end plate and the other one, 52, is referred to as the exhaust end plate. This terminology is used because the end plates can serve when equipped with suitable holes to open up the chamber, in synchronism with rotation of the rotor, to intake and exhaust manifolds. Hence, one side is referred to as the intake side and the other as the exhaust side, although these may be reversed or intake and exhaust can be fed radially through the chamber housing 50 instead of through the rotating end plates.

The intake end plate 51 is journalled to the intake housing 53 at the major shaft 55 that is fixed to plate 51 and concentric with the chamber axis 10. Similarly, the exhaust end plate 52 is attached to main shaft 56, journalled to the exhaust housing 54 concentric with the axis 10. A generally annular shaped intake manifold 57 may be provided in the intake housing and a similar exhaust manifold 58 may be provided in the exhaust housing. Furthermore, these manifolds may communicate with the chamber through valve ports that align with holes in the rotating plates in synchronism with the rotation of the rotor. This operation provides intake and exhaust for the chamber for two cycle internal combustion engine operation and is described more fully hereinbelow with respect to FIGS. 4 and 5.

Substantially identical bosses 61 and 62 are provided on the inside faces of the end plates 51 and 52, respectively. The bosses 61 and 62 are eccentrically located with respect to the chamber axis 10 and are aligned with each other. They carry opposite ends of the axle 32 and so they carry the double eccentric axle 31/32 on sleeve bearings 63 and 64 in the bosses 61 and 62, respectively.

The eccentric axle 31 is centrally journalled to the rotor 5 and a sleeve bearing 65 may be provided for this purpose. The rotor body 5 rides on axle 31 and preferably contacts only the sleeve bearing 65, the end plates 51 and 52 at the rotor peripheral seals 67 and 68 and the chamber side walls at seals 7 and 8 (see FIG. 2). Hence, the rotor preferably clears the bosses 61 and 62.

The axle 32 extends through the intake plate 51 into the gear space 71 between this end plate and the intake housing 53. In that space, the pinion gear 33 fixedly attached to the end of axle 32 meshes with internal gear 34 fixed to the housing. The ratio of 34 to 33 is 3:1 and so for each rotation of the two end plates on the main shafts along axis 10, the double eccentric axle 31/32 orbits three times around axis 10 and so moves the axis 12 of the rotor 5 over the hypocycloidal path around axis 10 controlling the position of the rotor in the chamber.

The second gear train which controls the attitude of the rotor at all positions in the chamber includes the gears 35 and 36. Gear 35 is an external gear fixedly attached to the end of boss 61 and so it is eccentrically located on the plate 51 and fixed thereto. The internal gear 36 which meshes with gear 35 is fixed to the rotor 5 and concentric with the rotor axis 12. The ratio of gear 36 to gear 35 is 2:1.

The housing of the mechanism shown in FIG. 3 is preferably rigid and stationary and includes the chamber body 50 attached as shown at each end to the intake housing 53 and exhaust housing 54 which carry the two ends 55 and 56, respectively, of the main shaft, on bearings 73 and 74, respectively. Since the end plates 51 and 52 rotate within the housing, these plates contact the housing at their bearings 73 and 74. In addition, seals may be provided to seal the chamber against leakage between the rotating end plates and the housings. For this purpose, circumferential seals are provided in each of the end plates carried by the end plates and bearing against a portion of the chamber body or the housing.

As shown in FIG. 3, the intake plate circumferentials seal 75 bears on a radially extending portion 77 of the chamber body 50. Similarly, the exhaust plate circumferentials seal 76 bears on radially extending portion 78 of the chamber body 50. Clearly, other types of seals can be provided between the rotating plates and the housing. For example, labyrinth seals could be used.

Figure 6:
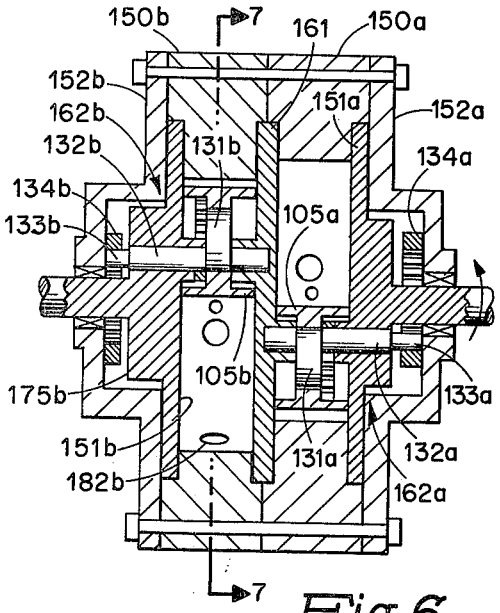
FIG. 6 is a cross section view taken at 6—6 in FIG. 7; through and parallel to the chamber axis of another embodiment which is a two rotor, four cycle internal combustion engine incorporating features of the embodiment shown by FIGS. 2 and 3.
Figure 7:
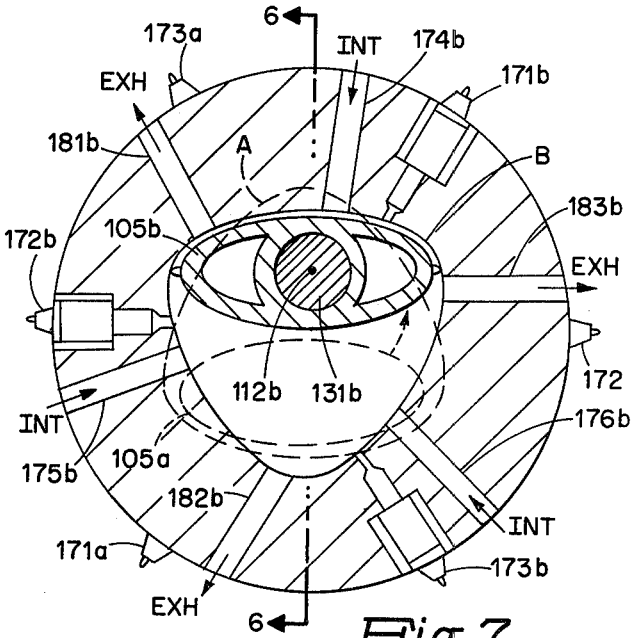
FIG. 7 is a cross section view of the engine shown in FIG. 6 taken at 7—7 transverse to the chamber axis showing the locations of the spark plugs and the locations of intake and exhaust ports to one of the chambers therein.

The rotating portion of the mechanism shown in FIGS. 2 and 3 is carried by the bearings 73 and 74. This mechanism may be balanced on axis 10 for smooth rotation by counter-balances attached to the main shafts 55 and 56 outside of the housing. A counter balance can also be provided by weights such as 79 and 80 attached to the edges of rotating end plates 51 and 52, respectively, opposite the rotor. Counter-balance can also be achieved by mechanically connecting two such rotary piston mechanisms in series with rotors oppositely located. A series connection operating as a four cycle internal combustion engine is illustrated by FIGS. 6 and 7.

Exhaust and Intake Ports in the Ends of the Chamber

Figure 4:
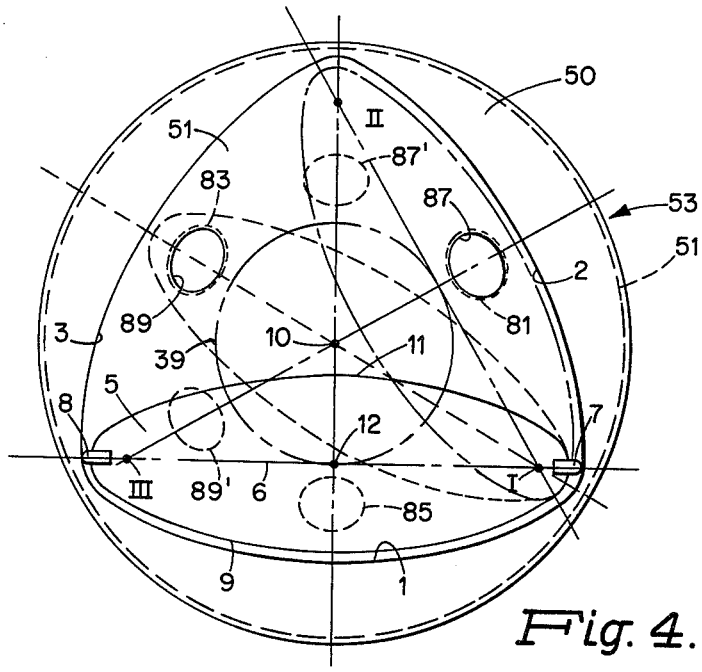
FIG. 4 is a diagram of the basic embodiment shown by FIGS. 2 and 3, taken at 4—4 in FIG. 3 along the chamber axis in the same direction as FIG. 2, showing the rotor, exhaust or intake ports, the stationary housing, exhaust or intake holes in an exhaust or intake end plate that rotates on the chamber axis and carries the rotor, the holes in the plate moving in registry with exhaust or intake ports in the housing to exhaust or intake gas from the portions of the chamber as required for the mechanism to perform as an internal combustion engine.

As shown in FIG. 4, the chamber defined by the walls 1, 2 and 3 is formed inside the chamber body 50 and the intake plate 51 of one end thereof carries a seal to insure that the plate and the body 50 are at all times sealed against leakage of gas or fluid. The intake housing 53 on the other side of the seal connects rigidly to the chamber body 50 and may be mechanically grounded. Intake ports are provided in this housing at fixed locations and so the intake ports are fixed with respect to the chamber. Three such intake ports are shown by dash lines in FIG. 4, and denoted 81, 83 and 85. Two similarly located openings (holes) are provided in the plate 51, denoted 87 and 89, and may be slightly smaller than the ports in the housing.

At the position of the rotor and end plate with respect to the housing shown by solid lines in FIG. 4, the openings 87 and 89 in the plate are in registration with the ports 81 and 83 in the housing 53. Thereafter, as the plate rotates ccw and the rotor rotates about its own moving axis 12 in the cw direction, the successive positions of the rotor and the plate openings are as illustrated by broken lines in FIG. 4. For example, the solid lines show a position of the rotor when the intake portion of the chamber, defined by walls 2 and 3 and surface 11 of the rotor, is opened to the ports 81 and 83. Thereafter, as the rotor rotates about its own axis 12 cw to the position represented by the dash lines, the two holes 87 and 89 in the intake plate will move out of registration with the ports 81 and 83 in the housing to the positions shown by dash lines 87' and 89'. At the next position of the rotor represented by the dot dash line, intake plate hole 87 will be in registration with port 83 and hole 89 will be in registration with port 85. This action of the rotating intake plate aligning plate holes and intake ports is illustrated further by FIGS. 5*a* to 5*g* which are diagrams showing the positions of the rotor and the positions of the holes in the plate and indicating by an X where these holes are in registration with stationary housing ports.

As shown in FIG. 3, an exhaust plate 52, the same size as the intake plate 51 covers the exhaust end of the chamber and connects to plate 51 by the double eccentric axle 31/32. Holes 88 and 90 in the exhaust plate 52, similar to holes 87 and 89 in the intake plate 51 align with exhaust ports 82, 84 and 86 in the exhaust housing 54 similar to ports 81, 83 and 85 in the intake housing 5, just prior to the alignment of the intake holes and ports, to exhaust the E side of the chamber before intake. These exhaust holes and ports are not all shown, but are located in relationship to each other just as their corresponding intake holes and ports as viewed along the axis 10 from the exhaust end to the intake end of the structure.

Two Cycle Operation of Exhaust/Intake Ports

Referring again to FIGS. 3, 4 and 5*a* to 5*g*, intake is through the intake housing manifold, ports and holes in intake plate 51 and exhaust is through holes in plate 52, exhaust ports and the exhaust manifold in exhaust housing 54. The exhaust holes 88 and 90 in the exhaust plate 52 may be located directly opposite intake holes 87 and 89, respectively. The exhaust ports 82, 84 and 86 at the exhaust manifold 58 are located so that two register with the exhaust holes in plate 52 at a time, just as two of the intake ports register with the intake holes at a time, but the exhaust ports register during the cycle just before the intake ports register. It is preferred that exhaust be completed before intake starts although some overlaps can be tolerated. For example, when operation is as a two cycle internal combustion engine, as shown in FIGS. 4 and 5*a* to 5*g*, exhaust and intake occur in rapid succession at the expansion portion E of the chamber. As this portion approaches full expansion, exhaust occurs, then the exhaust ports close and then intake occurs before compression begins. Thus, the arrangement of holes and ports for both intake and exhaust may be the same, but staggered so that exhaust and intake occur in the desired sequence as well as at the desired position of the rotor. This staggered arrangement is shown and described further in our U.S. Pat. No. 3,996,901, with respect to FIGS. 7 and 8 therein.

The sequence of FIGS. 5*a* to 5*g* shows the operation as a two cycle internal combustion engine. These figures represent the view from the rotor toward the exhaust end or toward the intake end of the chamber and show the condition (open or closed) of the ports in the exhaust or intake housings. FIGS. 5*a* to 5*g* show the intake port conditions in sequential steps. The corresponding exhaust port conditions in the same sequential steps are shown by the same figures in the reverse order 5*g* to 5*a*.

Intake or exhaust openings into the chamber may also be provided axially or radially. For example, other intake or exhaust or both may be through central axial openings in the end plates concentric with the chamber axis 10 and the main shaft 55/56. Where such a central opening is provided in a rotating end plate, the shaft on the outside of the plate may be hollow and so provide a connecting passage to the plate opening. A control valve in the hollow shaft or in a conduit to the hollow shaft would control the timing of fluid flow therethrough. Where intake is provided by this technique and exhaust is through the rotating exhaust plate holes as they align with exhaust ports in the exhaust housing, exhaust occurs first and then intake and so the intake would be delayed with respect to the exhaust to insure that they do not both occur simultaneously. This could be implemented by adding a control valve before the intake opening in the drive shaft, which delays input until the holes in the rotating exhaust plate move just out of registration with the exhaust ports. FIGS. 5*a* to 5*g* may represent this action also.

Figure 5A:
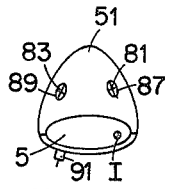
FIGS. 5*a* to 5*g* are diagrams showing the successive positions of the rotor in the chamber and the registration of the exhaust or intake holes in the rotatng exhaust or intake end plate with the exhaust or intake ports in the housing of the basic embodiment shown by FIGS. 2 and 3.
Figure 5B:
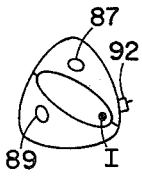
Figure 5C:
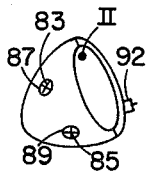
Figure 5D:
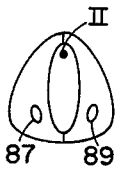
Figure 5E:
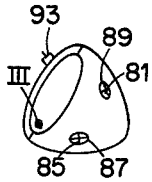
Figure 5F:
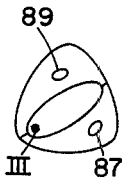
Figure 5G:
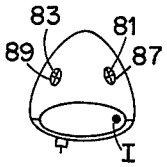

As shown by FIGS. 5*a* to 5*g*, the power stroke is initiated by a spark from spark plug 91 driving the rotor 5 in its cw rotation about axis I. In FIG. 5*b*, the rotor is shown half way rotated about axis I to its position adjacent wall 2 of the chamber. At this midway point, all the intake ports as well as the exhaust ports are closed and so the power expansion continues in one portion of the chamber and compression of the combustible mixture taken in occurs in the other portion of the chamber. This cycle completes at the position shown in FIG. 5*c* where the intake ports 83 and 85 are open (represented by an X on the port), commencing the next cycle of the engine. This next cycle of the engine and the third cycle are shown in the subsequent FIGS. 5*d*, 5*e*, 5*f* and 5*g*. Meanwhile, the exhaust side of the chamber closed by rotating end plate 52 operates as illustrated by FIGS. 5*g* to 5*a* while the intake side is operating as illustrated by FIGS. 5*a* to 5*g*. To follow simultaneous operation of the intake and the exhaust sides of the chamber view FIGS. 5*a* to 5*g* in sequence as shown for the intake and at the same time for the exhaust, view FIGS. 5*g* to 5*a* in sequence substituting reference numbers 52, 82, 84, 86, 88 and 90 for 51, 81, 83, 85, 87 and 89, respectively.

Four Cycle Internal Combustion Engine

The mechanism of the present invention shown in FIG. 3 can also be used in a four cycle rotary piston internal combustion engine, such as described in our copending Patent application Ser. No. 445,930. However, in four cycle operation with two or more chambers and pistons in series or tandem, intake and exhaust to the chamber through openings in the rotating intake and exhaust plates which align with the exhaust ports in the housings cannot be readily accomplished. Instead, fuel intake and exhaust passages into the chamber are provided by way of radial openings through the chamber body which open at the chamber walls 1, 2 and 3. Furthermore, since it is not possible to exert a power stroke each time the rotor rotates successively about the axes I, II and III, there cannot be six power strokes for each revolution of each rotor. FIGS. 8*a* to 8*f* show one sequence of rotation of the rotor in the chamber to perform as a four cycle internal combustion engine with intake, compression, power and exhaust sub-cycles accompanying each power stroke.

Figure 8A:
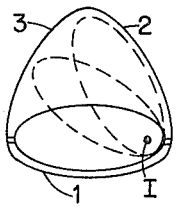
FIGS. 8*a* to 8*f* are diagrams showing one of the chambers of FIG. 6 and the successive positions of the rotor therein to perform the subcycles of the four cycle engine.
Figure 8B:
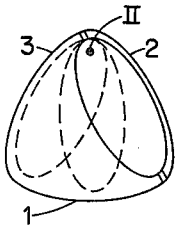
Figure 8C:
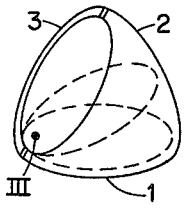
Figure 8D:
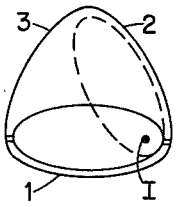
Figure 8E:
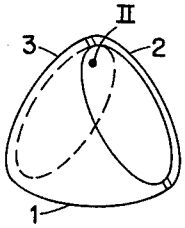
Figure 8F:
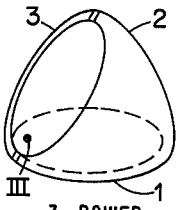

As shown in FIGS. 8*a* to 8*f*, for each complete rotation of the rotor, it rotates six times about the axes I, II and III in succession. The first rotation about I is a power stroke, the next about II is also a power stroke, the next about III is an intake stroke, the next about I is an intake stroke, the next about II is a power stroke and the last about III is also a power stroke. Thus, two power strokes occur in succession followed by two strokes which do not deliver any power, and this is again followed by two power strokes to complete one cycle of rotation of the rotor in the chamber. It should be noted that the first power stroke shown in FIG. 8*a* is accompanied by a compression stroke and the second is accompanied by an exhaust stroke and so forth as indicated in these figures.

Figure 9A:
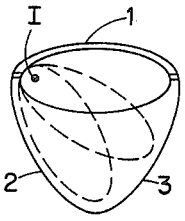
FIGS. 9*a* to 9*f* are diagrams showing the same successive positions of the other chamber of the four cycle engine shown in FIGS. 6 and 7.
Figure 9B:
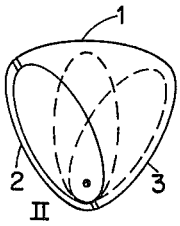
Figure 9C:
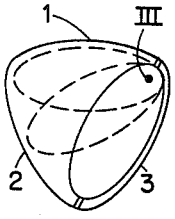
Figure 9D:
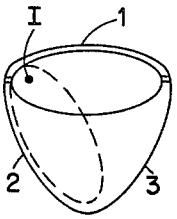
Figure 9E:
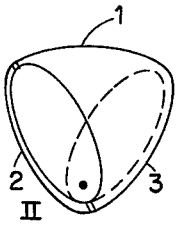
Figure 9F:
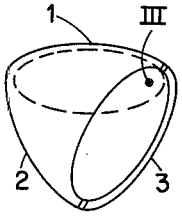

In a four cycle engine incorporating the present invention, two chambers in mechanical series or tandem are provided, each containing a rotor and both rotors are carried on a single output drive shaft. Two chambers (or an even number of chambers) are preferred so that the action in each can be staggered with respect to the action in the other. For example, if the action in the first chamber (referred to herein as the A chamber) is as represented by FIGS. 8*a* to 8*f*, then the action in the second chamber adjacent thereto (referred to herein as the B chamber) would be represented by FIGS. 9*a* to 9*f*. More particularly, while the A chamber is performing a power/compression stroke as shown in FIG. 8*a*, the B chamber is performing an intake/exhaust stroke as shown in FIG. 9*a*. Furthermore, while the A chamber is performing an intake/exhaust stroke as in FIG. 8*c*, the B chamber is performing a power/compression stroke as in FIG. 9*c*, and so forth. Thus, the two rotors in the two chambers perform six power strokes for each rotation of the rotors. Or expressed in another way, there are three power strokes for each cycle of rotation of the crankshaft structure formed by the rotors, exhaust and intake plates and output drive shaft.

A two chamber, two rotor, four cycle internal combustion engine incorporating the rotor position and attitude control mechanism of the present invention and operating substantially as shown in FIGS. 8*a* to 8*f* and 9*a* to 9*f* is shown in cross section in FIG. 6. In this engine, the mechanism for controlling the position and attitude of each rotor in its chamber is the same as the mechanism shown in detail in FIGS. 2 and 3. That is, each rotor is carried between two rotating end plates on a double eccentric axle and two gear trains for each rotor control the position and attitude of the rotor in its chamber. However, in this four cycle embodiment, the intake plate does not provide an opening for injecting a combustible mixture into the chamber, but rather, all combustible intake into and all exhaust from the chambers is through ports which extend substantially radially from the chamber walls through the chamber bodies that contain the chamber. Suitable valving is provided to control the flow of intake and exhaust through these ports in synchronism with the operation of the engine.

As shown by FIGS. 6 and 7, within the A chamber is located rotor 105*a* and in B chamber is located rotor 105*b*. As already mentioned, the mechanisms for controlling the position and attitudes of these rotors in their chambers is the same as already described herein with respect to FIGS. 2 and 3. For example, chamber A is oriented as represented in FIGS. 8*a* to 8*f* and chamber B is oriented oppositely, as represented in FIGS. 9*a* to 9*f*. This is also shown in FIG. 7.

Dividing the two chambers, A and B, is rotating end plate 161 which functions as a central (common) end plate for both of the chambers. More particularly, double eccentric axles 31/32*a* and 31/32*b* which connect to the end plates 151*a* and 151*b*, respectively, also connect to the central plate 161.

The position and attitude control mechanism for carrying and positioning rotor 105*a* in the A chamber is denoted generally 162*a* and the same mechanism for carrying rotor 105*b* is denoted 162*b*. These mechanisms, the rotating end plates are mounted to the two gear trains for each and the mounting to their associated housings 153*a* and 153*b* are all as already described herein with reference to FIGS. 2 and 3. Hence, a detailed description of these mechanisms is not included herein with reference to this four cycle engine emgodiment.

FIG. 7 is a cross section view taken through the B chamber as shown in FIG. 6. This reveals the location of the radial intake and exhaust ports as well as the spark plugs 171*b*, 172*b* and 173*b* for the B chamber. As shown here, there are provided three intake ducts 174*b*, 175*b* and 176*b* through the chamber body 150*b*, opening as the walls 101*b*, 102*b* and 103*b*, respectively, of the B chamber alongside the spark plugs of this chamber. The chamber body 105*b* also contains exhaust ports which are denoted 181*b*, 182*b* and 183*b*. Similarly located intake and exhaust openings are provided in the chamber A body 150*a* as well as spark plugs denoted 171*a*, 172*a* and 173*a*. The radial intake and exhaust openings into chamber A are not shown, but are located relative to chamber A just as the radial intake and exhaust ports to chamber B are located with respect to that chamber.

Fluid Motor and Fluid Pump

Figure 13:
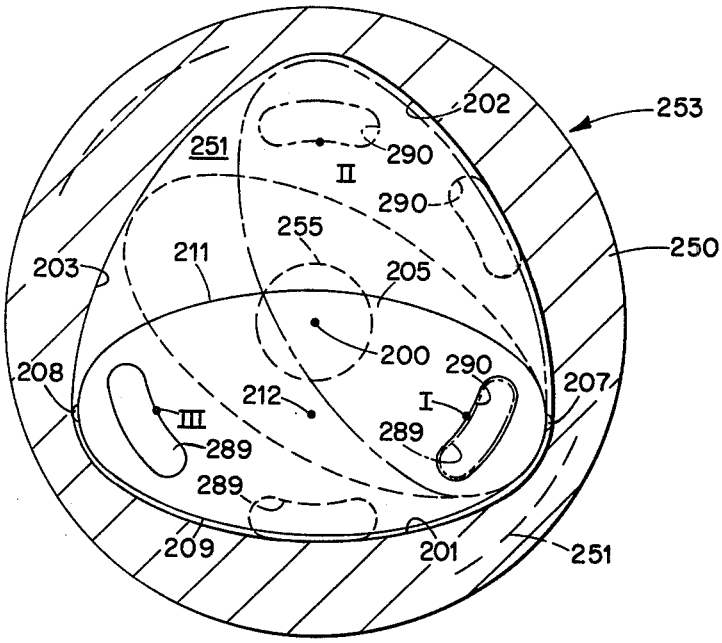
FIG. 13 is a diagram showing the chamber rotor and exhaust end intake system for a fluid motor, fluid pump or compressor incorporating the rotor position and attitude control mechanism of any of the basic embodiments of the present invention.
Figure 14:
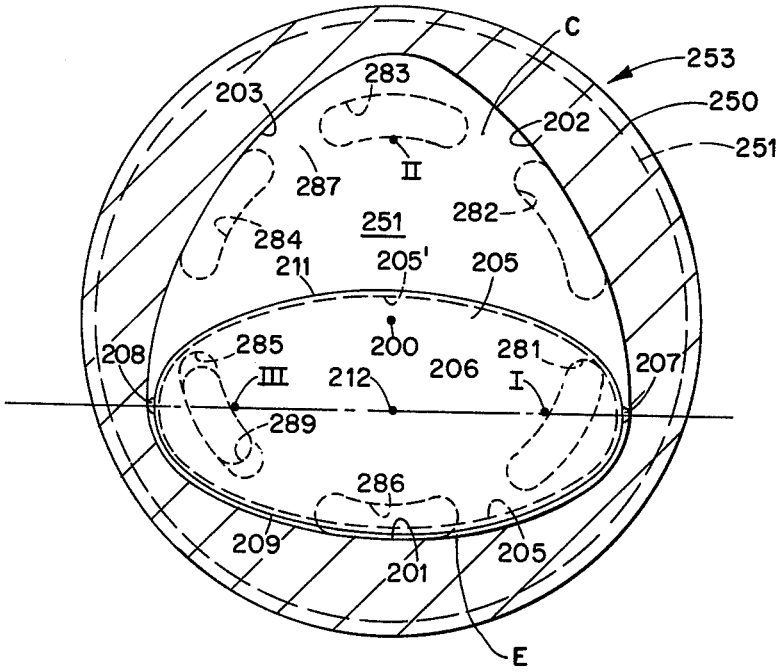
FIG. 14 is a diagram serving to explain the operation of the intake and exhaust in such a fluid motor, pump or compressor.

The operation of a fluid motor and a fluid pump or compressor, incorporating the basic structure shown by FIG. 3 which includes the rotor and chamber configuration and position and attitude control of the rotor of the present invention, can be understood by reference to the intake and exhaust port action illustrated diagrammatically by FIGS. 13 and 14. These figures show the rotor, chamber body, rotating intake end plate and intake housing with intake holes and ports that align to permit intake into the chamber from one side and exhaust holes and ports that align to permit exhaust from the opposite side of the chamber. These Figures are both cross section view diagrams taken toward the intake end, and parts that correspond to parts in FIG. 3 bear a reference number which is two hundred greater.

The chamber walls 201, 202 and 203 may conform to the walls 1, 2 and 3, respectively, described with reference to FIGS. 1 and 2 and the rotor position and attitude control mechanism (not shown here) is the same as shown in FIGS. 2 and 3. However, the shape of the rotor 205 is somewhat different from rotor 5 and may carry double vanes 207 at one end and double vanes 208 at the other end. The rotor is symmetrical with respect to its longitudinal axis 206 and the sides 209 and 211 conform closely with the walls 201, 202 and 203 when the rotor closes with a wall. Accordingly, when the rotor has closed with a wall, as shown in FIGS. 13 and 14, the width of the rotor transverse to its longitudinal axis may be sufficient that the rotor covers the chamber axis 200.

The rotating intake end plate 251 covers the intake end of the chamber sealing against the chamber body 250 and is enclosed by the intake housing 253 similar to the arrangement of plate 51, chamber body 50 and housing 53 and seals as shown in FIG. 3. The major shaft 255 extends from the center of the plate 251 to bearings in the housing also as shown in FIG. 3. The rotating exhaust end plate 252 (not shown) covers the other end of the chamber and is supported by the other end of the major shaft at a bearing in the exhaust housing 254 that encloses that plate, similar to the exhaust plate 52 and exhaust housing 54 shown in FIG. 3.

In general, the configuration of the fluid motor or pump is the same as shown in FIG. 3 except that the locations of the intake and exhaust ports are somewhat different. The similarity to FIG. 3 includes the connection of the two rotating end plates 251 and 252 at each end of the chamber to provide a crankshaft-like structure for holding the rotor and the double eccentric axle and gear trains (not shown) which is part of this structure, for controlling the position and attitude of the rotor in the chamber. Also, the rotating intake and exhaust end plates 251 and 252 close the ends of the chamber, carry the rotor and control mechanism and serve also to open and close intake and exhaust ports to the chamber.

As shown by FIG. 14, the intake into the chamber is through elongated ports 281 to 286 in the housing 253 which provide a continuous annular opening except for support structure such as 287 between each opening. The single intake hole 289 in the intake end plate 251 aligns with one of these elongated ports at a time as shown in FIG. 14. when the rotor covers the intake hole 289, as shown in this figure, flow into the chamber through the hole is blocked. The rotor peripheral seals 205' and 205'', seal against the intake and exhaust plates 251 and 252, respectively, that close the chamber and prevent flow from the covered hole into either the compression or the expansion portions (C or E) of the chamber.

Exhaust from the expansion side of the chamber is through a single exhaust hole in the rotating exhaust plate 252 (not shown in FIG. 14). The exhaust plate and exhaust housing may be constructed substantially the same as the intake plate 251 and intake housing 253. The exhaust housing may also contain a plurality of elongated ports just like intake ports 281 to 286 and in registration therewith. In fact, the only significant difference between the intake system and the exhaust system is that the intake hole 289 and the similar exhaust hole 290 in the exhaust plate 252 are at opposite ends of the rotor as shown diagrammatically by FIG. 13. For example, when the rotor is positioned as shown in FIG. 13 represented by solid lines, the intake hole 289 is in the position shown represented by solid line and the exhaust hole 290 is at the position indicated by the solid line 290 and both these holes are covered by the rotor.

Thereafter, as the rotor rotates about axis I, as shown in FIG. 13, the intake and exhaust holes 289 and 290 both move ccw as viewed in FIG. 13 at twice the rate of rotation of the rotor about the central rotor axis 212. Successive positions of the rotor and these intake and exhaust holes are shown in FIG. 13. The solid line rotor position corresponds with the solid line intake and exhaust hole positions 289 and 290, respectively. At the solid line position, both holes are covered by the rotor.

When the rotor rotates a few degrees from the solid line position, both intake and exhaust holes move out from under the rotor. At the thirty degree rotor position, represented by the dash line, both holes are well uncovered and both remain at least partially uncovered until the rotor reaches the sixty degree rotor position represented by the dot dash line. The corresponding hole positions are also represented by dot dash lines and, again, they are both covered by the rotor.

This sequence continues and provides a fundamental rotary piston mechanism for use in a fluid motor, fluid pump or compressor. In such a fluid motor, high pressure fluid is fed to the intake ports and a starting torque is applied to the shaft that connects to the intake and exhaust plates to initiate the motor action. Then at each position when the rotor covers the intake and exhaust holes, inertia carries the rotor through the position to again uncover the holes and so, continues the motor cycle.

In a fluid pump or compressor, the periodic covering of both intake and exhaust holes by the rotor creates no problem. It very briefly interrupts the intake and exhaust and if the fluid is compressible, this interruption is hardly noticeable.

Second Embodiment — One Chamber End Plate Rotating

The mechanism for controlling rotor position and attitude and the rotor may be carried by a single rotating end plate and the other end plate for the chamber may be fixed and part of the housing. This is illustrated by the structure shown in FIGS. 10 and 11 and is adaptable for use in a two or four cycle internal combustion engine, a fluid motor, pump or compressor.

Figure 10:
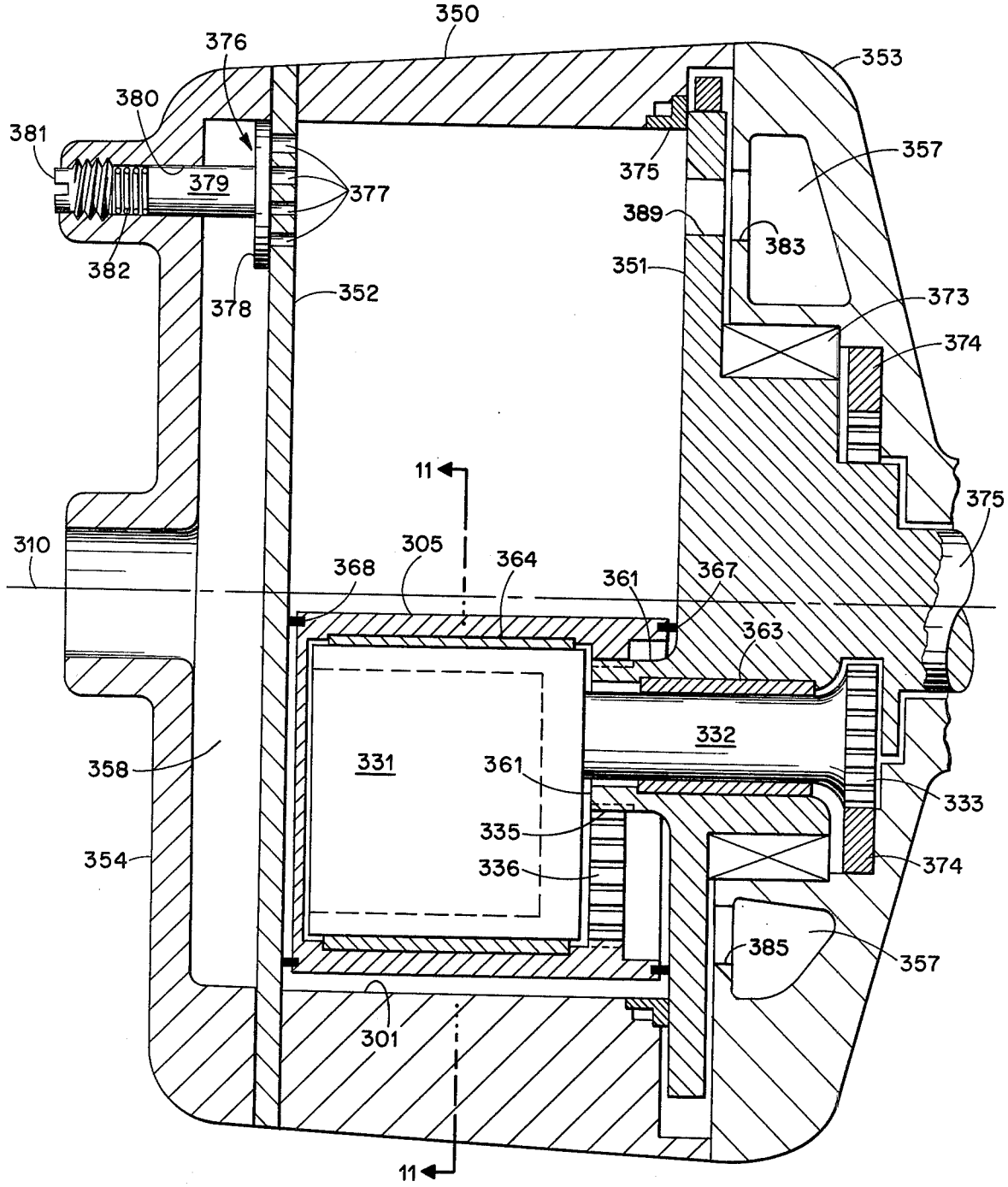
FIG. 10 illustrates another basic embodiment of the present invention including one fixed end plate and a single rotating end plate carrying the rotor on the double eccentric axle, cantilevered therefrom, showing a cross section view taken at 10—10 in FIG. 11 through the chamber axis parallel thereto.
Figure 11:
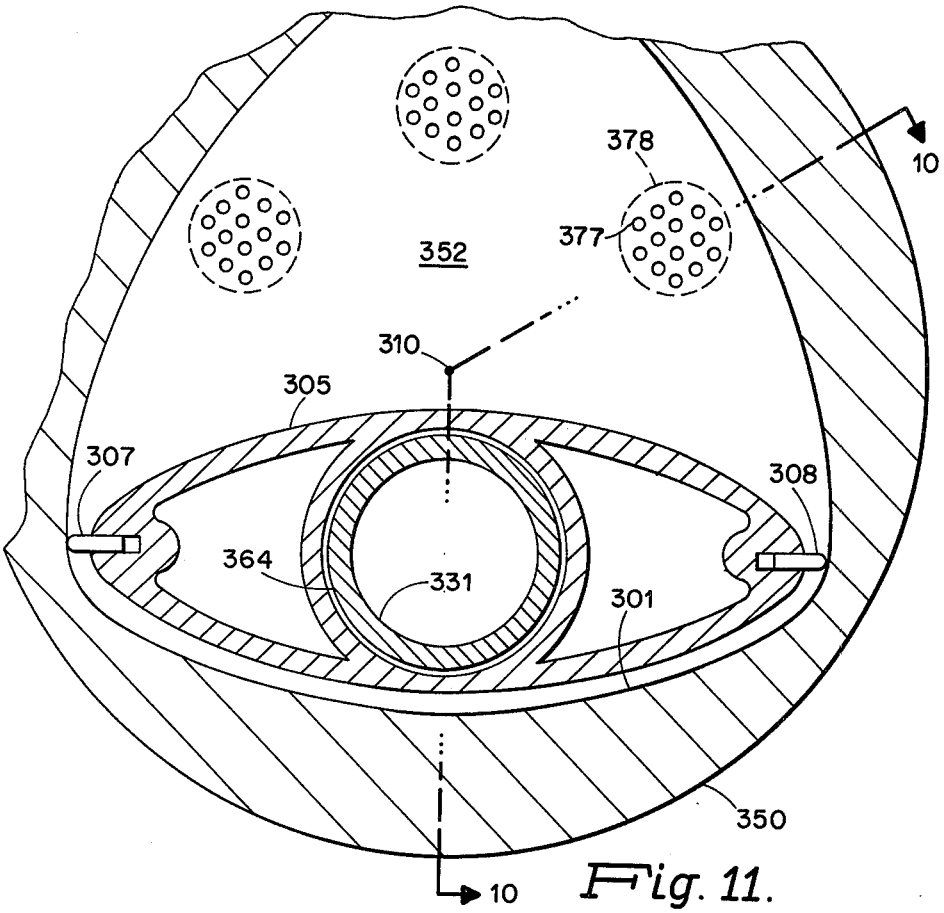
FIG. 11 is a cross section view of the embodiment shown in FIG. 10 taken at 11—11 transverse to the chamber axis showing the cantilevered double eccentric axle and relative orientation of the rotor and intake and exhaust.

As shown in FIGS. 10 and 11, the chamber body and the exhaust housing and exhaust end plate may be formed in a single integral piece. The portion of this piece that defines the chamber side walls is denoted 350, the fixed exhaust end plate 352, the exhaust housing 354 and the exhaust manifold 358. The intake housing 353 is sealably attached to the chamber body 350 at a radially extending portion thereof. Within the housing on the major shaft bearing 373 is mounted the rotating intake end plate 351 carrying the rotor 305 in cantilever fashion. Thus, the plate 351 is mounted in the housing to rotate on the chamber axis 310 and extends from the housing as the major shaft 355 which is the output shaft in the case of an engine or motor or which is the input in the case of a compressor or pump.

An eccentric boss 361 projects from the inside face of plate 351 and carries the double eccentric axle 331/332. Axle 332 is equivalent, functionally to axle 32 in FIG. 3 and is carried within the boss 361 concentric therewith on sleeve bearing 363. Fixed to the rotor end of axle 332 is the eccentric rotor axle 331 that carries the rotor at bearing 364. At the other end of the first axle 332 is attached pinion gear 333 which is one of the gears in the rotor position gear train drive. The pinion gear meshes with internal gear 334 fixed to the intake housing 353. Thus, as the intake end plate 351 rotates on bearing 373, the center of rotor axle 331 (which is coincident with the rotor axis 312, the geometric center of the rotor), moves along the three cusp hypocycloidal path around the chamber axis 310.

The second gear train within the mechanism that controls rotor attitude includes external gear 335 fixed to the end of the eccentric boss 361 that extends from the plate. This gear meshes with internal gear 336 fixed to the rotor. The ratio of gears in the first train, gears 334 and 333 which control the rotor position, is 3:1. The ratio of gears in the second train, gears 335 and 336 which control rotor attitude, is 2:1. Hence, as the intake end plate 351 rotates on axis 310, the rotor is moved about the chamber as described herein with reference to FIGS. 1 and 2 and both the rotor position and attitude are independent of forces between the rotor and the chamber side walls 301, 302 and 303.

A stationary seal 375 attached to the chamber body 350 bears against the inside face of the rotating intake plate 351 and seals the chamber from the intake manifold 357. Intake into the chamber is through intake holes, such as 389 in the plate 351 as these holes align with ports such as 383 and 385 from the intake manifold 357. The arrangement and location of the intake holes and ports for a two cycle engine, a four cycle engine, a fluid motor, compressor or pump may be substantially as described herein with respect to operation of the other embodiment of such an engine, motor, pump or compressor.

The chamber exhaust may be through radial ports in the side walls of the chamber, such as shown in FIGS. 6 and 7, that are appropriately equipped with valves or axial exhaust ports, or controlled by valves, may be provided through the fixed end plate 352. A suitable mechanism (not shown) may be provided driven by the major shaft 355 for controlling such exhaust valves.

As an alternative, for a pump or compressor, exhaust may be through pressure actuated poppet valves, such as poppet valve 376, located substantially at the positions of ports 281 to 286, shown in FIG. 14. The poppet valves, not covered by the rotor would open when chamber pressure exceeded a predetermined amount. Each poppet valve includes a valve plate 377 that covers a cluster of holes 378 through the fixed end plate 352 from the chamber to the exhaust manifold 354. The valve plate is at the end of a piston 379 sliding in a bore 380 through the housing that is capped by an adjusting screw 381. A coil spring 382 acts between the screw and the piston. The spring force on the piston holds the poppet valve closed and is adjustable by the screw 381.

Cam Driven Sealing Vanes

In any embodiment of the present invention, including the mechanism for controlling rotor position and attitude so that rotor position and attitude are independent of rotor contact with the side walls of the chamber, the rotor may be equipped with variable vanes that seal against the side walls of the chamber. For example, the vanes may be driven in and out at the end of the rotor so that the vane tip to vane tip dimension of the rotor changes as the rotor rotates. Where the basic rotor action in the chamber is as described herein with respect to FIG. 1, variation of the vane tip to vane tip dimension of the rotor as it rotates permits chamber configurations other than the generally triangular shape that is described. For example, with a suitable control drive of the vanes, the chamber could be circular. This is shown in FIG. 12 which is a cross section view of a rotary piston mechanism that would appear in transverse cross section as shown in FIG. 3. That is, construction of this embodiment would be the same as shown in FIG. 3, but with a circular chamber instead of a generally triangular chamber and with a cam mechanism (shown in FIGS. 3 and 12) for driving the vanes. Hence, reference should be made to both FIGS. 3 and 12 in the description of this embodiment and the same reference numbers are used as in FIG. 3 except that the chamber body in FIG. 12, since it is now circular instead of triangular, is given the reference number 50'.

As shown in FIGS. 3 and 12, a cam slot 91 is provided in the eccentric rotor axle 31 providing a generally oval shaped cam surface 92 that is preferably an integral part of the total double eccentric axle 31/32. As shown in FIG. 12, vane plungers 93 and 94 sliding in plunger bores 95 and 96 in vanes 107 and 108 have cam rollers 97 and 98, respectively, at their inside ends acted upon by the cam. These plungers contact springs 99 and 100 in the bores and the springs contact the sliding vanes 107 and 108 at the ends of the rotor. The sliding vanes extend the full width of the rotor and slide in accomodating slots 109 and 110, respectively. Each of the plunger springs is loaded at all times between the plunger and sliding vane so that the vane is forced against the chamber side walls by a steady force over the full extension of the vanes.

In operation, the rotor is carried by the intake and exhaust plates 51 and 52 on the double eccentric axle 31/32, and the two gear trains, the position gear train including gears 33 and 34 and the attitude gear train including gears 35 and 36, precisely determine the position and attitude of the rotor in the chamber independent of any contact between the rotor vanes and the chamber side walls. As the rotor rotates on rotor axle 31, cam 92 rotates with respect to the vane plungers 93 and 94 positioning the vanes under spring force precisely as required to seal against the circular chamber side wall. Thus, the rotor action is the same as already described above with reference to FIGS. 2 and 3 and the end plate and housing is substantially the same. Furthermore, intake and exhaust can be accomplished using any of the techniques already described herein. The use of variable or sliding vanes permits use of the simpler circular chamber construction.

The numerous embodiments of the present invention illustrates a novel mechanism for controlling the position and attitude of a rotary piston in two and four cycle internal combustion engines, fluid motors, pumps and compressors. These represent the best known uses of the mechanism to accomplish the rotary piston action described and it will be apparent to those skilled in the art that additional mechanisms are required to provide a complete useful two or four cycle internal combustion engine, fluid motor, pump or compressor. For example, the engines require carburetors feeding a mixture of gasoline and air to the intake manifolds and, in the two cycle engines where there is no intake stroke, the mixture from the carburetor must be fed to the intake manifold under some pressure and so there must be some sort of pump in the intake system.

The combustion and operation of these and other additional mechanisms are apparent to those skilled in the art as are various changes, modifications and other uses of the present invention that can be made without departing from the spirit and scope of the invention as set forth in the appended claims.

What is claimed is:

1. A rotary piston mechanism for internal combustion engines, fluid motors, pumps and the like comprising, an outer body having means forming a chamber therein, a rotor confined in said chamber, said chamber having a chamber axis circumscribed by curved side walls, said rotor being generally elongated, and having a rotor axis centrally located therein and parallel to said chamber axis, a rotor carrier rotatably supported by the outer body for rotation on the chamber axis, a first axle rotatably carried by the rotor carrier eccentric of the chamber axis and parallel thereto, first gear means acting between the first axle and the outer body for rotating said axle when the rotor carrier rotates, a second axle attached to and eccentric with respect to the first axle, the rotor being rotatably carried on the second axle concentric with the rotor axis and second gear means acting between the rotor and the rotor carrier for rotating the rotor on the second axle, whereby the rotor rotates continuously in one direction, closing successively with said walls a multitude of times with each revolution of the rotor carriers.

2. A rotary piston mechanism as in claim 1 wherein, the rotor is generally symmetrical with respect to a plane through the length thereof parallel to the rotor axis having two elongated sides and two ends, and an elongated side of the rotor coincides with a side wall of the chamber when the rotor closes with a wall of the chamber.

3. A rotary piston mechanism as in claim 1 wherein, the locus of the rotor axis about the chamber axis through one revolution of the rotor carrier defines a hypocycloid figure, said figure having the same said multitude of equal curved sides which are concave with respect to the chamber axis.

4. A rotary piston mechanism as in claim 3 wherein,
the ratios of gears in said first and second gear means being such that the rotor rotates one-sixth of a revolution between successive closings with walls of the chamber.

5. A rotary piston mechanism as in claim 3 wherein,
the ratios of gears in said first and second gear means being such that the rotation of the rotor on said rotor axis is opposite in sense to the movement of the rotor axis about the chamber axis.

6. A rotary piston mechanism as in claim 5 wherein,
the ratios of gears in said first and second gear means being such that the movement of the rotor axis about the chamber axis cycles at a rate twice the rate of rotation of the rotor about the rotor axis.

7. A rotary piston mechanism as in claim 1 wherein,
said multitude is three and
the first gear means includes a gear train from the first axle to the outer body having a ratio of 1:3.

8. A rotary piston mechanism as in claim 7 wherein,
the second gear means includes a gear train from the rotor carrier to the rotor having a ratio of 1:2.

9. A rotary piston mechanism as in claim 8 wherein,
the first gear means includes a gear attached to the first axle meshing with a gear attached to the outer body,
the second gear means includes a gear attached to the rotor carrier meshing with a gear attached to the rotor.

10. A rotary piston mechanism as in claim 1 wherein,
the rotor carrier forms an end wall of the chamber,
the first and second axles are fixedly attached together,
the first gear means includes a gear attached to the first axle meshing with a gear attached to the outer body and
the second gear means includes a gear attached to the rotor carrier meshing with a gear attached to the rotor.

11. A rotary piston mechanism as in claim 1 wherein,
said multitude is three
there are three curved side chamber walls, circumscribing the chamber axis and defining an equilateral chamber triangle in a plane perpendicular to the chamber axis and
the rotor is generally elongated and of length equal to the span of the chamber along the bisector of any angle of said equilateral triangle.

12. A rotary piston mechanism as in claim 11 wherein,
the rotation of the rotor with respect to the chamber is successively about axes located substantially at the corners of said chamber equilateral triangle.

13. A rotary piston mechanism as in claim 12 wherein,
the portion of each of the chamber walls within the arc of an angle of said equilateral chamber triangle are of equal radius,
the center of each of said arcs being the opposing points of the equilateral triangle.

14. A rotary piston mechanism as in claim 13 wherein,
the angular length of each of said wall arcs centered at the opposing point of the equilateral triangle is substantially 60°.

15. A rotary piston mechanism as in claim 14 wherein,
the corners of the chamber where two of the chamber walls meet define corner arcs of the chamber of equal radius less than the radius of said wall arcs.

16. A rotary piston mechanism as in claim 15 wherein,
said corner arcs are each centered at the nearest point of the equilateral chamber triangle.

17. A rotary piston internal combustion engine comprising,
an outer body having means forming a chamber therein,
a rotor confined in said chamber, said chamber having a chamber axis circumscribed by curvilinear side walls and means closing the ends of the chamber,
said rotor being generally elongated, and having a rotor axis centrally located therein and parallel to said chamber axis,
a rotor carrier rotatably supported by the outer body for rotation on the chamber axis,
a first axle rotatably carried by the rotor carrier eccentric of the chamber axis and parallel thereto,
first gear means acting between the first axle and the outer body for rotating said axle when the rotor carrier rotates,
a second axle attached to and eccentric with respect to the first axle,
the rotor being rotatably carried on the second axle concentric with the rotor axis, and
second gear means acting between the rotor and the rotor carrier for rotating the rotor on the second axle,
whereby the rotor rotates continuously in one direction, closing successively with said walls a multitude of times with each revolution of the rotor on the rotor axis,
sealing means at each end of the rotor which sealably engages a wall of the chamber at all times so that the chamber is divided into two portions, one increasing in volume and the other decreasing in volume as the rotor rotates,
means for exhausting the chamber,
means for feeding a combustible fluid mixture into the chamber, and
means for igniting said mixture in the chamber,
whereby the mixture combusts producing gas which expands forcing said rotor to rotate which drives the rotor carrier in rotation on the chamber axis and a mechanical output means engaged by the rotor carrier and drive in rotation thereby.

18. A rotary piston internal combustion engine as in claim 17 wherein,
the rotor carrier closes at least one of the ends of the chamber along the chamber axis.

19. A rotary piston internal combustion engine as in claim 18 wherein,
a housing attached to the outer body encloses the rotor carrier,
the mechanical output fixedly connects to the rotor carrier and is rotatably supported by said housing.

20. A rotary piston internal combustion engine as in claim 19 wherein,
gas ports are fixedly located in said housing,
gas holes are located in the rotor carrier and said holes align with said ports to provide one or more paths for gas flow between the chamber and the housing.

21. A rotary piston internal combustion engine as in claim 20 wherein, means are provided for closing the other end of the chamber, another housing attached to the outer body encloses said other end closing means, an opening is provided through said closing means to provide one or more paths for gas flow between the chamber and the other housing.

22. A rotary piston internal combustion engine as in claim 18 wherein, the said means for closing the other end of the chamber connects to the rotor carrier by the first axle and rotates with the rotor carrier on the chamber axis and both are referred to as rotating chamber end closing means.

23. A rotary piston internal combustion engine as in claim 22 wherein, one of said rotating chamber end closing means is the exhaust closing means and the other is the intake closing means, the exhaust housing encloses said exhaust closing means and attaches to the outer body, the mechanical output is an output drive shaft on the chamber axis connected to one of said end closing means and rotatably supported by the housing, the rotor is rotatably carried by both the intake and the exhaust end closing means, the intake housing encloses the intake closing means and attaches to the outer body, and at least one intake path is provided for conducting said combustible mixture through the intake housing and through the intake closing means into the chamber.

24. A rotary piston internal combustion engine as in claim 23 wherein, the intake path is defined by intake holes in the intake closing means and intake ports in the intake housing, said holes and ports are displaced from the chamber axis and said intake holes and ports are in registration at predetermined rotational positions of the rotor in the chamber.

25. A rotary piston internal combustion engine as in claim 17 wherein, the means for exhausting includes exhaust holes in the exhaust closing means and exhaust ports in the exhaust housing, and said exhaust holes and ports are in registration at predetermined rotational positions of the rotor in the chamber.

26. A rotary piston mechanism as in claim 1 wherein, projecting side wall seals carried by the rotor sealably contact the chamber side walls dividing the chamber into two portions, one increasing in volume and the other decreasing in volume as the rotor rotates and means are provided for varying the projection of the seals so that the seals at all times contact the side walls.

27. A rotary piston mechanism as in claim 26 wherein, the seals are carried slideably in the rotor and means acting upon the seals to vary the projection thereof from the rotor is carried by the rotor.

28. A rotary piston mechanism as in claim 27 wherein, means attached to the second axle acts in cooperation with said means acting upon the seals to vary the projection of the seals from the rotor.

29. A rotary piston mechanism as in claim 28 wherein, the means attached to the second axle is a cam and the means acting upon the seals is a cam follower.

30. A rotary piston mechanism as in claim 29 wherein, a spring acts between the cam follower and the seal.

* * * * *